United States Patent [19]

Shemitz et al.

[11] 4,218,727

[45] Aug. 19, 1980

[54] LUMINAIRE

[75] Inventors: Sylvan R. Shemitz, Woodbridge; Benjamin L. Stahlheber, Clinton, both of Conn.

[73] Assignee: Sylvan R. Shemitz and Associates, Inc., West Haven, Conn.

[21] Appl. No.: 921,839

[22] Filed: Jul. 3, 1978

[51] Int. Cl.[2] ..... F21V 7/00

[52] U.S. Cl. ..... 362/297; 362/346; 362/350; 362/290

[58] Field of Search ..... 362/290, 297, 346, 348, 362/350

[56] References Cited

U.S. PATENT DOCUMENTS

| | | | |
|---|---|---|---|
| 1,610,124 | 12/1926 | Godley | 362/348 X |
| 1,694,067 | 12/1928 | Lewis | 362/346 X |
| 1,757,527 | 5/1930 | Henningsen | 362/346 X |
| 2,110,018 | 3/1938 | Halvorson | 362/297 |
| 2,414,657 | 1/1947 | Mitchell | 362/350 |
| 3,944,810 | 3/1976 | Grindle | 362/297 |
| 4,006,355 | 2/1977 | Shemitz et al. | 362/290 X |

*Primary Examiner*—Peter A. Nelson

*Attorney, Agent, or Firm*—DeLio and Montgomery

[57] ABSTRACT

A luminaire having parabolic reflector elements to obtain strong crossed beams of reflected light forming the main components in a batwing distribution, with elliptical reflector elements to reflect light toward the center and mid-zones of the distribution pattern but not toward the peripheries, to improve the uniformity of the illumination on a surface and to reduce direct discomfort glare. The luminaire has special utility for uplighting, to illuminate a ceiling which can thus produce indirect illumination of an area, relatively free from veiling reflections.

10 Claims, 7 Drawing Figures

X3
3½"
R"
50°
24½"
6"
6½"
12"
49"
5'6"

X2
5"
R'
65°
24½"
6"
6½"
12"
59½"
5'6"

X1
3"
R
55°
24½"
6"
6½"
12"
52"
5'6"

LUMINAIRE

This invention relates to luminaires, of square or circular cross section, wherein the reflecting surfaces include a combination of one parabolic element and three elliptical elements, so proportioned and oriented as to produce very uniform distribution of light, particularly when the luminaire is used for uplighting, to illuminate a ceiling, from an installed position which may be somewhat below standing eye-level.

The present invention resulted from experimentation to improve the distribution of illumination achieved by the luminaires shown in the applicants' U.S. Pat. No. 4,006,355, which was found to be somewhat too bright near the periphery of the pattern and relativey too dark near the center. This result was due to the fact that presently available high intensity discharge lamps have a thinner phosphor coating on the inside of the outer glass envelope than did similar lamps of the immediate past. The arc tube light output of the most modern lamps is too great in relation to the light output of the phosphor coating, and the parabolic reflectors, in the patented luminaires, were too efficient at flashing (reflecting parallel rays) the arc tube light out into the periphery of the light distribution pattern. As the basic reflector was modified, by adding insert reflectors of predetermined shapes, it has been discovered that not only has the uniformity of illumination been improved, but the luminaires have the desirable characteristic of low brightness at normal viewing angles without the need of the radial light absorbing surfaces (louvers) of U.S. Pat. No. 4,006,355. While the addition of such louvers can still provide superior performance in certain combinations of lamp orientation and luminaire mounting dimensions, as explained below, the performance is generally excellent without the use of the radial louvers.

It is accordingly an object of the present invention to provide luminaires wherein parabolic and ellipitcal reflector elements are combined in a manner to effect very uniform distribution of illumination.

It is a further object of the invention to provide an improved system of reflector elements which is adaptable to luminaires of either square or circular cross section.

It is another object of the invention to provide luminaires which may be installed in uplighting positions at heights below standing eye level with minimal direct discomfort glare.

It is a still further object of the invention to provide certain improvements in the form, construction and arrangement of the several elements of the luminaires whereby the above-named and other objects may effectively be attained.

The invention accordingly comprises the features of construction, combinations of elements, and arrangement of parts which will be exemplified in the constructions hereinafter set forth, and the scope of the invention will be indicated in the claims.

Practical embodiments of the invention are shown in the accompanying drawings, wherein.

Figure 1:
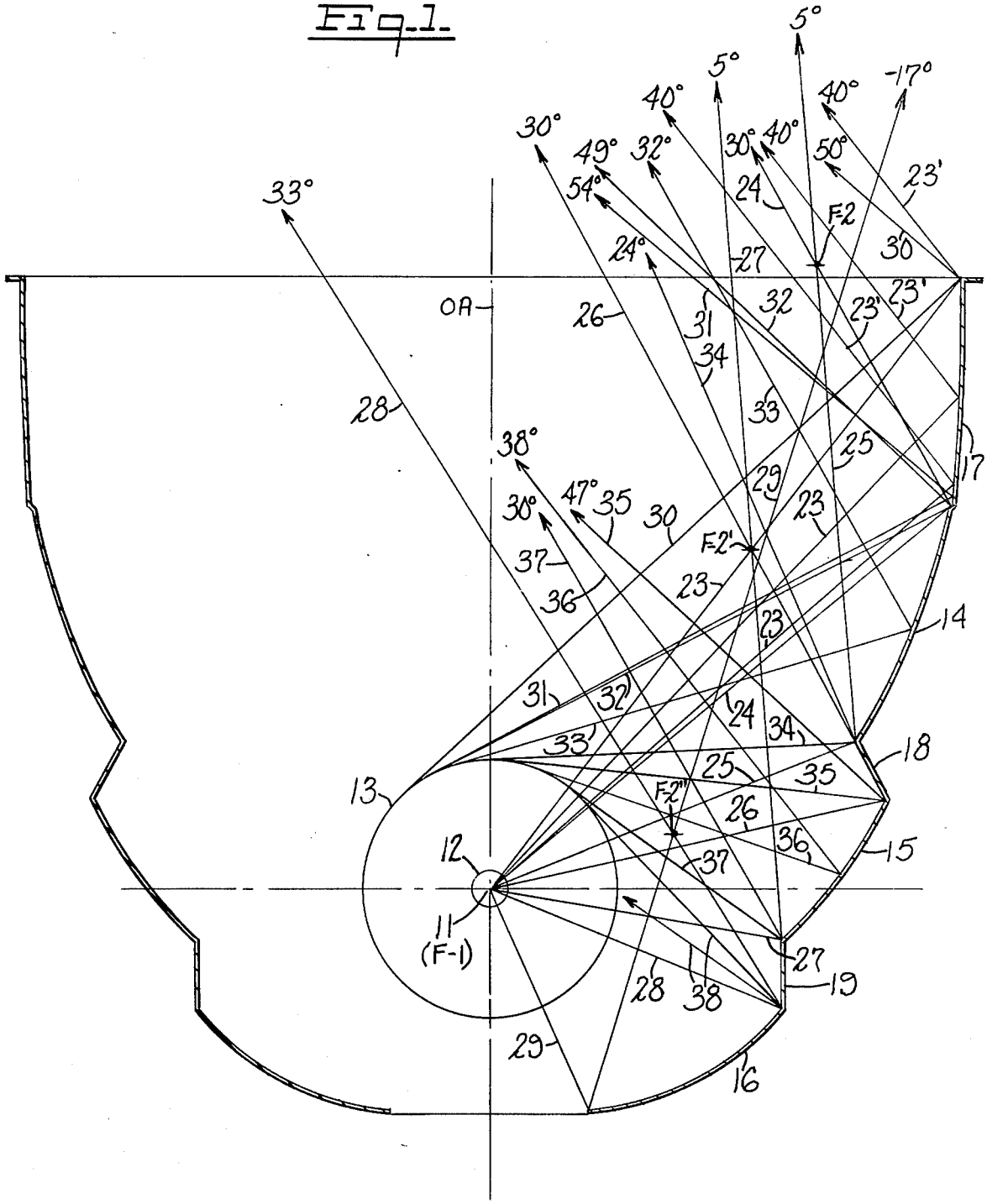
FIG. 1 is a diagrammatic vertical section of a square luminaire having a horizontally oriented lamp, showing the light emanations and reflections.
Figure 2:
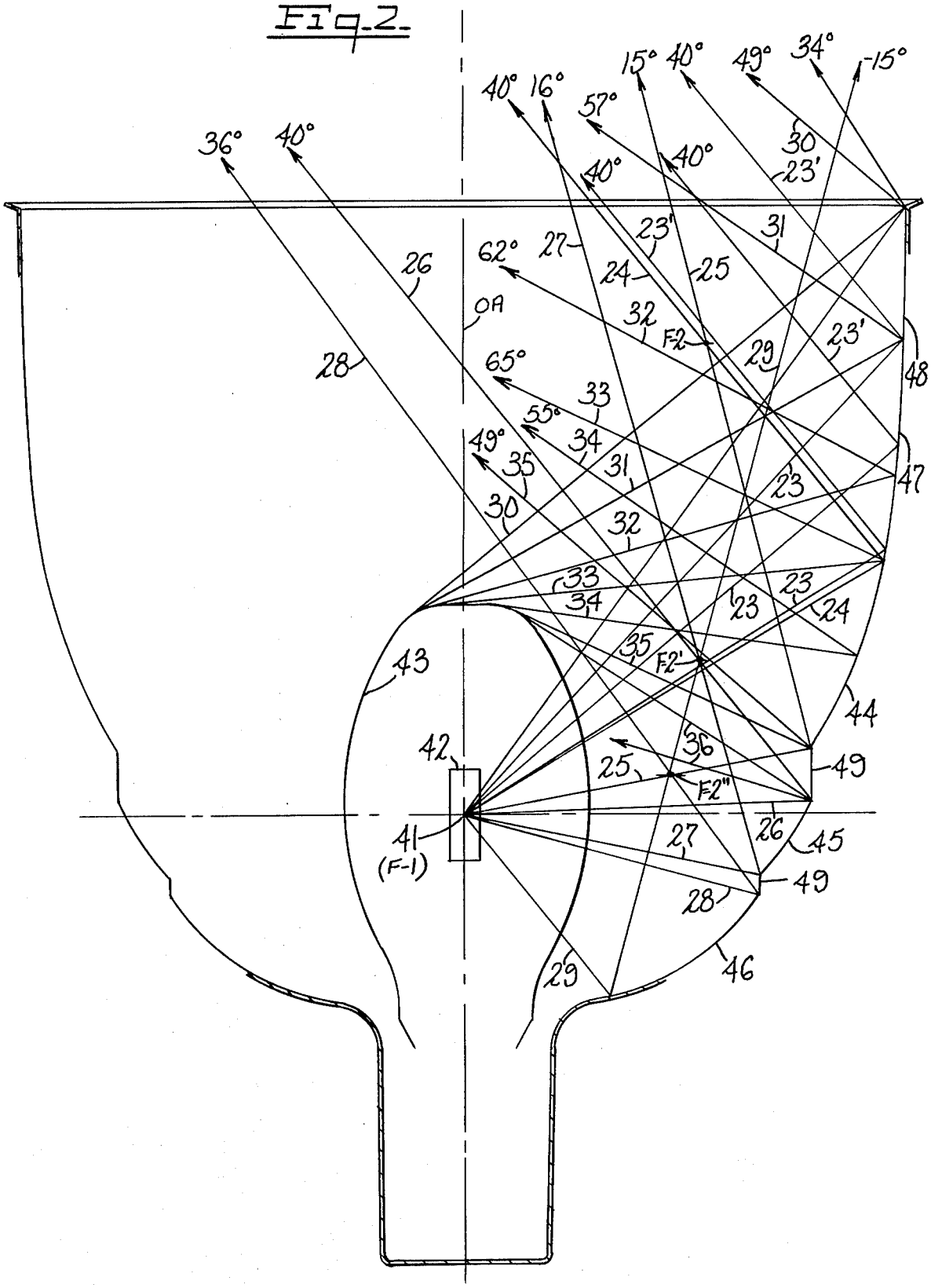
FIG. 2 is a diagrammatic vertical section of a round luminaire having a vertically oriented lamp, showing the light emanations and reflections from a reflector formed as a surface of revolution of the specified shapes.
Figure 3:
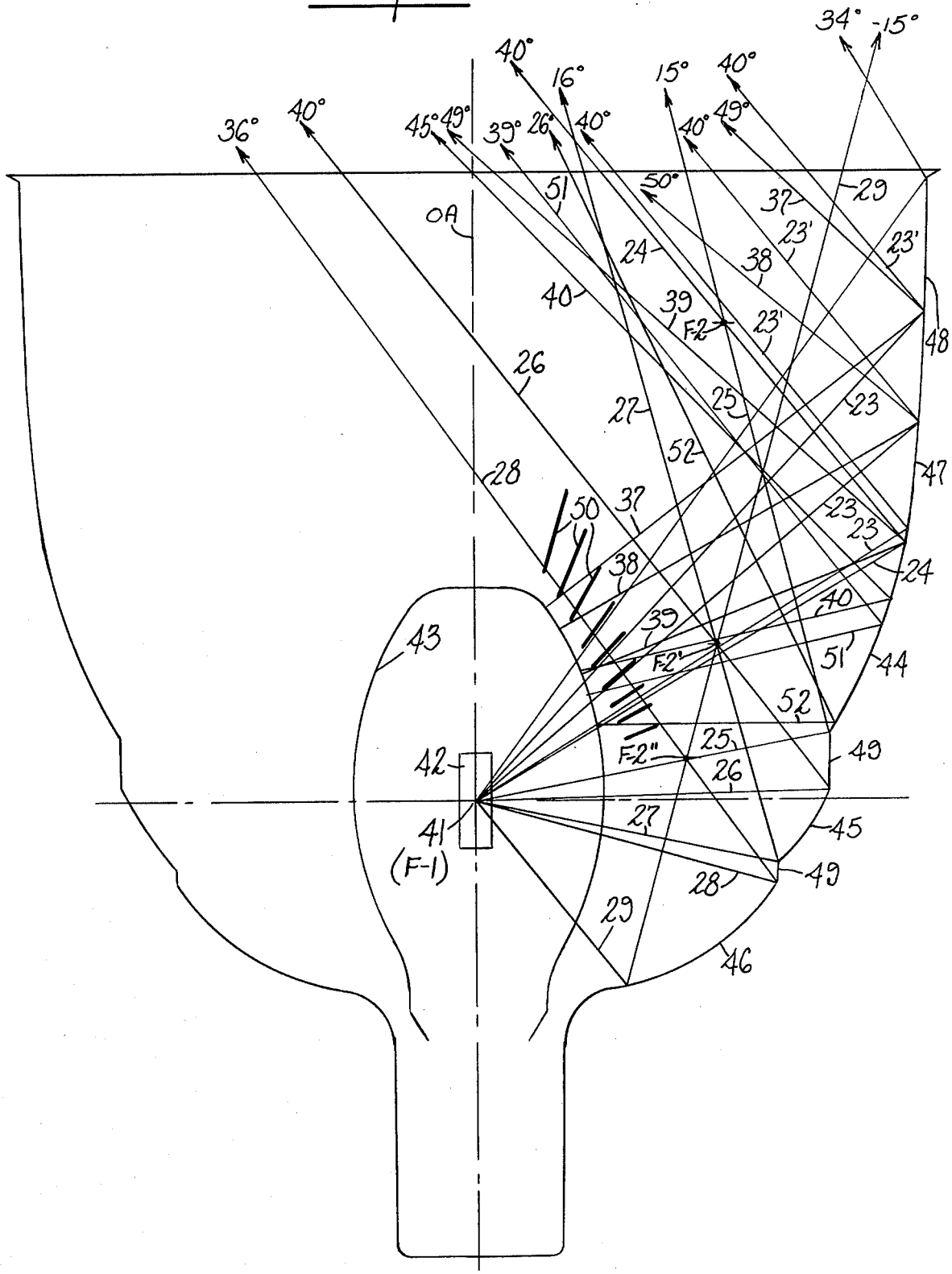
FIG. 3 is a diagrammatic vertical section of a luminaire similar to that shown in FIG. 2 with the addition of radial louvers.
Figures 4, 5, 6:
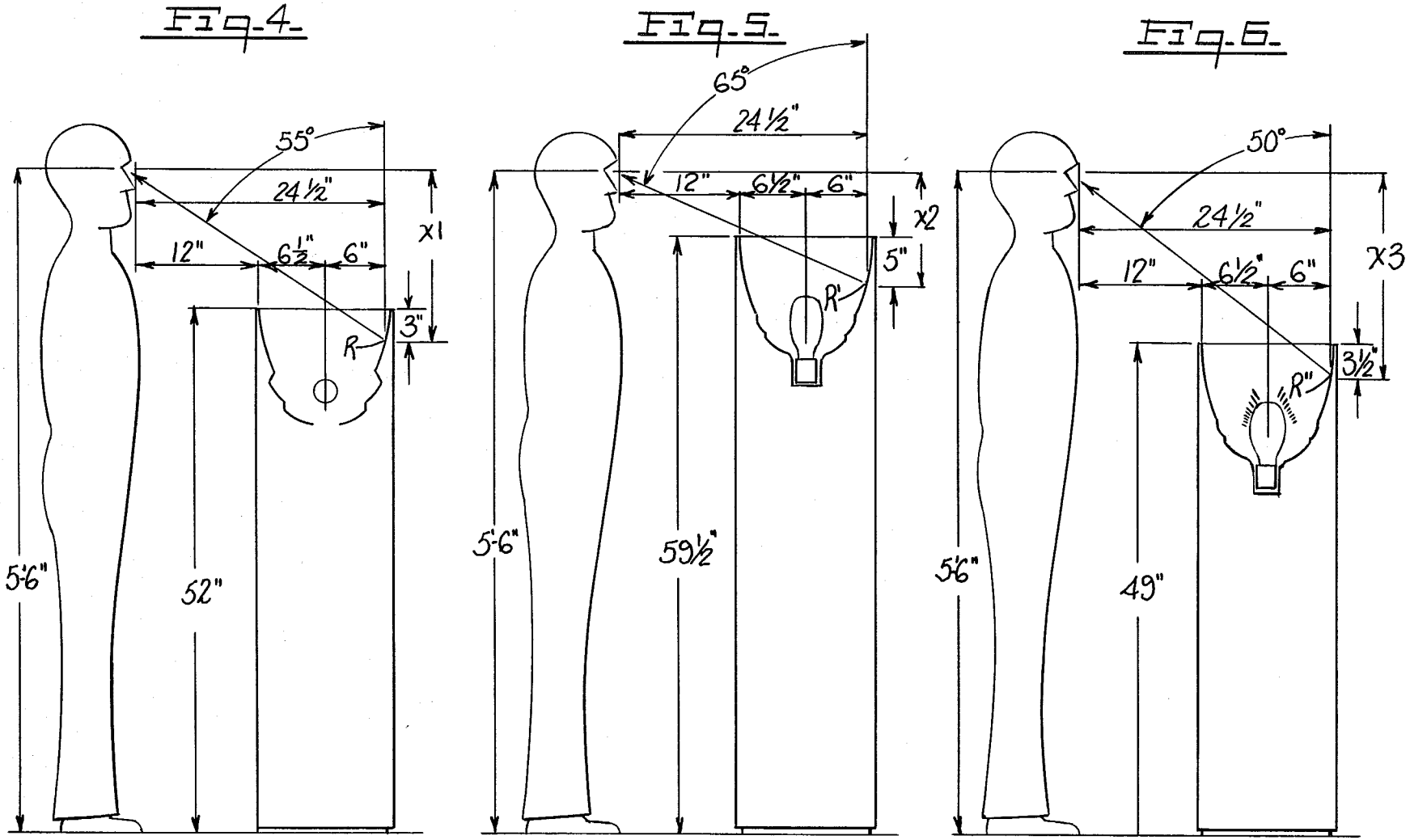

FIGS. 4, 5 and 6 are diagrammatic elevations showing the light rays that are reflected the greatest angle from zenith relative to an observer standing near an uplighting fixture containing the luminaires of FIGS. 1, 2, and 3, respectively, at selected heights above floor level; and FIG, 7 is a diagrammatic elevation illustrating the light distribution from the luminaire of FIG. 2 relative to a ceiling, serving as a secondary light source.

Referring to the drawings, and particularly FIG. 1, the light source or lamp has an optical center 11, an arc tube 12 if the lamp is a high intensity discharge lamp, and an outer glass envelope 13, which has a phosphor coating on the inside. The light diffusing property could also be produced by an outside frosting.

The elliptical reflector elements are the outer ellipse 14, the middle ellipse 15 and the inner ellipse 16. The parabolic reflector element 17 is located beyond the outer edge of the outer ellipse. Between the adjacent ellipses 14–15 and 15–16 are transition or connecting elements 18, 19, painted matte black and having no optical value.

A well-known optical reflection characteristic of an elliptical reflector is that, if a light source is located at one of the two foci of the ellipse, a light ray will, after one reflection, pass through the second focus of the ellipse.

Parabolic reflectors also have a well-known optical reflection characteristic—light that originates at the focus will reflect off the reflector in parallel rays which are parallel to the axis of the reflector. Light rays 23 striking the parabolic surface 17 are reflected on parallel paths at an angle of 40° from zenith.

The first focus of each ellipse, and the focus of the parabola, is F-1 (11). The second focus of the outer ellipse is F-2, the second focus of the middle ellipse is F-2', and the second focus of the inner ellipse is F-2''. All the rays 23 from the focus F-1 which are reflected by the parabola 17 follow the parallel paths 23' at an angle of about 40° from zenith.

The center of the light source or lamp is located at F-1 (11). Ray 24 and ray 25, after one reflection by ellipse 14, pass through F-2. Ray 26 and ray 27, after one reflection by ellipse 15, pass through F-2'. Ray 28 and ray 29, after one reflection by ellipse 16, pass through F-2''. These rays delineate the nominal boundaries of the elliptical reflector reflections.

The reflections 14–25 from outer ellipse 14 in FIG. 1 diverge throughout the zone of about 5° from zenith to 30° from zenith, zenith being straight up. The reflections 26–27 from middle ellipse 15 in FIG. 1 diverge throughout the zone of about 5° from zenith to about 30° from zenith. The reflections 28–29 from inner ellipse 16 in FIG. 1 diverge throughout the zone of about 17° to one side of zenith to about 33° to the other side of zenith.

The second foci of the ellipses are located progressively farther from the optical axis OA of the luminaire, that is, F-2 is farther from the axis than is F-2', and F-2' is farther from the axis than is F-2''. If that relationship is changed, the resulting uniformity of illumination and discomfort glare would be worse than desirable.

Any possible luminaire brightness in the field of view of the user would be the result of tangential light rays from the lamp's light diffusing envelope, such as rays 30 through 37 of FIG. 1. But the ray that reflects out at the greatest angle from zenith, ray 31, is only about 55° from zenith, so the luminaire depected by FIG. 1, mounted as shown in FIG. 4, is essentially void of direct discomfort glare.

A suitable mounting position for the square luminaire with horizontal lamp, shown in FIG. 1, is illustrated in FIG. 4 where the nominal standing eye height is 66 inches and the mounting height for the luminaire aperture or rim is 52 inches minimum, for prevention of direct discomfort glare at a distance of 12 inches from the near side of the luminaire. Determination of the correct minimum mounting height is made with reference to the point of reflection R of the lowest ray, 31 R being 3 inches below the rim, the vertical distance from that point to eye height being designated as X1, and the horizontal distance from that point to the observer being 24½ inches, as shown. Given this latter distance and the angle of reflection from zenith.

$$\frac{24\frac{1}{2}}{X1} = \tan 55°$$

$$X1 = \frac{24\frac{1}{2}}{\tan 55°} = \frac{24\frac{1}{2}}{1.43} = 17.1 \text{ inches } (17'')$$

The luminaire mounting height is thus ascertained as:

$$66 - X1 + 3 = 66 - 17 + 3 = 52 \text{ inches, minimum.}$$

In FIG. 2 the light source has an optical center 41, an arc tube 42 and an outer glass envelope 43 with a phosphor coating on the inside, as in the lamp of FIG. 1.

The reflector elements are formed as surfaces of revolution, the three elliptical reflecting surfaces, corresponding to the surfaces 14, 15 and 16 of FIG. 1 being identified as 44, 45, and 46, while the parabolic surface is 47. The element 48, at the outer edge of the parabola, is a straight line element, at a diverging angle of about one degree, to facilitate the removal of the spun reflector from a spinning foam. As in the case of elements 18 and 19, the cylindrical elements 49 are merely transition or connecting surfaces, painted matte black, which have no optical value.

For convenience in comparison, the rays in FIG. 2 are given the same designation as the rays in FIG. 1. Their distribution is similar but the angular limits differ somewhat. The reflections of rays 24 and 25 from the outer ellipse 44 diverge throughout the zone of about 15° from zenith to 40° from zenith. The reflections of rays 26 and 27 from the middle ellipse 45 diverge throughout the zone of about 16° from zenith to about 40° from zenith. The reflections of rays 28 and 29 from the inner ellipse 46 diverge throughout the zone of about 15° to one side of zenith to 36° on the other side of zenith. The reflections of rays 23 from the parabolic surface 47 follow the parallel paths 23'at an angle of about 40° from zenith.

From FIG. 2, any possible luminaire brightness in the field of view of the user would be the result of tangential light rays from the lamp's light diffusing envelope, such as rays 30 through 35. But the ray that reflects out at the greatest angle from zenith, ray 33, is only about 65° from zenith, so the luminaire would be mounted at the higher mounting height above the floor shown in FIG. 5.

The minimum mounting height for a round luminaire with vertical lamp (FIG. 2) is illustrated in FIG. 5 wherein eye height, observer position and luminaire size are the same as before, but the point R' from which the lowest ray, 33, is reflected is 5 inches below the rim and the angle of reflection is 65° from zenith. In this case $$\frac{24\frac{1}{2}}{X2} = \tan 65°$$

$$X2 = \frac{24\frac{1}{2}}{\tan 65°} = \frac{24\frac{1}{2}}{2.145} = 11.45 \text{ inches } (11\tfrac{1}{2}'')$$

and $66 - X2 + 5 = 66 - 11\frac{1}{2} + 59\frac{1}{2}$ inches minimum.

If it were desirable or advantageous to mount the luminaire of FIG. 2 at a lower height, direct discomfort glare could be prevented by the addition of the louvers 50, shown in FIG. 3. In this figure, the light source and the reflecting surfaces ar the same as in FIG. 2 but the light distribution is controlled additionally by the use of louvers 50, corresponding to the louvers 25 in FIG. 4 of U.S. Pat. No. 4,006,355, set at angles substantially radial to the center of the light source. In this position, the louvers cut off rays emanating tangentially from the envelope 43 so that the ray reflecting out at the greatest angle from zenith is ray 38, which is only about 50° from zenith for a purpose described below in connection with FIG. 6. Other rays from the surface of the envelope are designated 37, 39, 40, 51 and 52, all being reflected at smaller angles.

The minimum mounting height for the louvered luminaire of FIG. 3 is illustrated in FIG. 6 where the point R'' (reflection of ray 38) is 3½ inches below the rim and the angle of reflection is 50° from zenith. The applicable equations are $$\frac{24\frac{1}{2}}{X3} = \tan 50°$$

$$X3 = \frac{24\frac{1}{2}}{\tan 50°} = \frac{24\frac{1}{2}}{1.192} = 20.6 \ (20\tfrac{1}{2}'')$$

and $66 - X3 + 3\frac{1}{2} = 66 - 20\frac{1}{2} + 3\frac{1}{2} = 49$ inches minimum.

Figure 7:
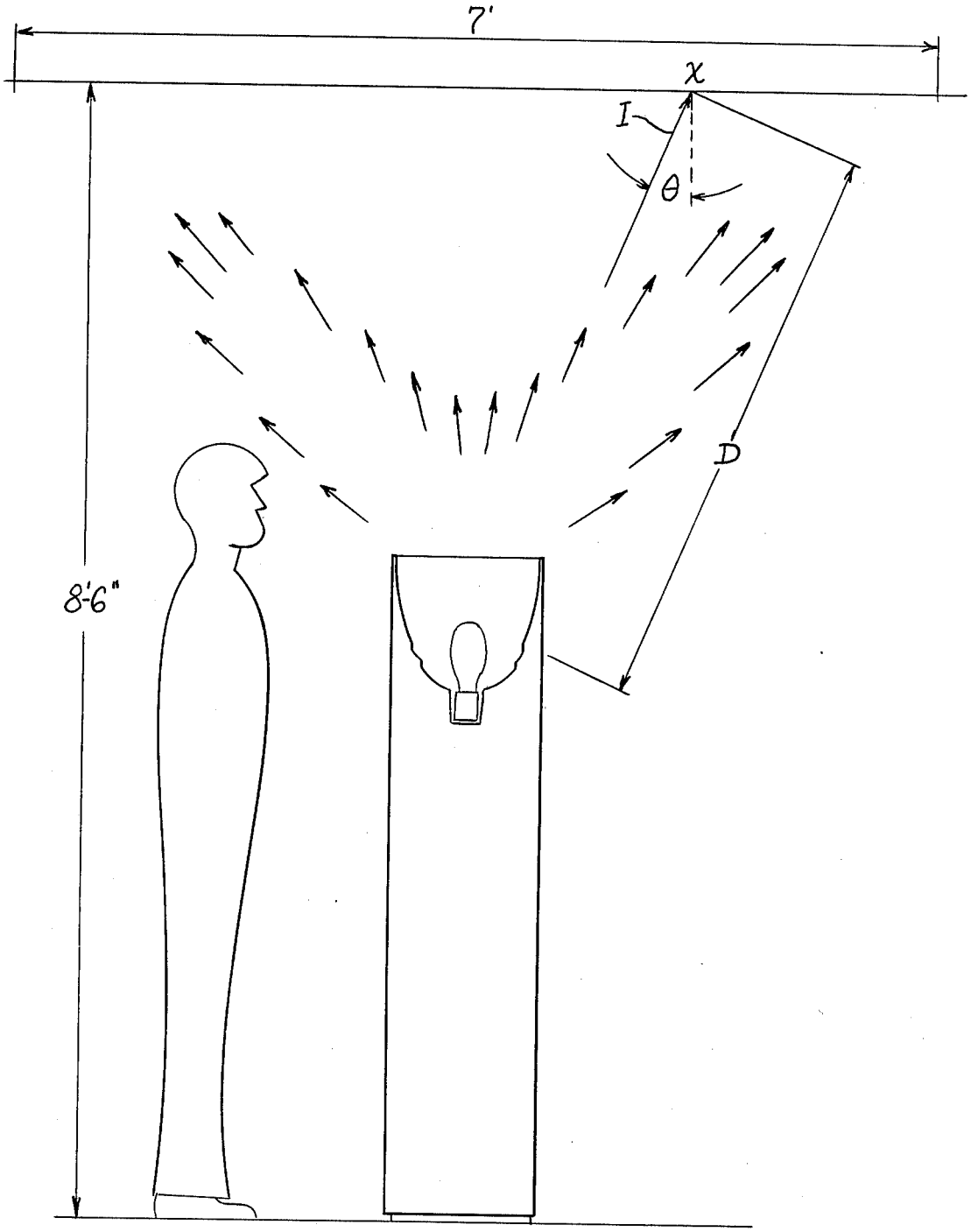

FIG. 7 is a diagrammatic view of a typical round luminaire used to provide indirect illumination. The luminaire illuminates the ceiling, and the ceiling becomes a secondary light source. For a round luminaire (FIG. 2), the illuminated pattern on the ceiling would be a circular pattern as indicated. For a square luminaire (FIG. 1), the illuminated pattern would be a square (with smoothed-off corners). For a ceiling with nominal height of 8'6", the approximate diameter of the illuminated circle is 7 feet.

The candlepower distribution from the luminaire is approximatey as indicated by the small arrows, which show the well-known batwing shape. The illumination at any point, such as point x, on the ceiling, can be calculated from the inverse square law, with cosine correction, the equation $$E = \frac{I}{D^2} \times \cos\theta, \text{ where}$$

E=illumination, in footcandles.

I=intensity, in candlelas of candlepower.

D=distance from light source to the point under consideration, in feet.

$\theta$=the angle between the light ray and the normal (imaginary line perpendicular to the surface being illuminated).

Many calculations, made at a multitude of points within the illuminated circle (or square) are found to yield substantially identical answers, showing that the illumination is very uniform.

While the provision of a luminaire constituted by parabolic and elliptical elements designed and arranged as disclosed above has been found to give optimal results, it may be noted that each of the reflector elements could depart somewhat from truly parabolic or truly elliptical shape and still produce distribution patterns which could be considered acceptable under certain conditions. Such departures can include the use of one or more substantially plane (flat) elements in the square luminaire (FIG. 1) or one or more substantially conical elements in the round luminaire (FIGS. 2 and 3), so long as such plane or conical surfaces are disposed in positions corresponding substantially to chords of the parabolic and elliptical arcs 14, 15, 16, 17 or 44, 45, 46, 47, shown and described herein. In such positions the modified reflector elements can distribute light in zones which correspond generally to those defined for the elliptical and parabolic elements, while having somewhat different range limits.

The luminaires are described and shown as being used for uplighting to produce indirect illumination which uses the ceiling of the facility as a secondary light source. Such illumination is inherently free from veiling reflections, since illumination at any point on the work plane is made up from contributions from every point on the illuminated ceiling which has an unobstructed "view" to the point on the work plane. However, the luminaires may be equally useful for downlighting, thereby producing uniform direct illumination on the work plane, which illumination is relatively free from veiling reflections, and the luminaires having desirable low brightness at high angles, which precludes direct discomfort glare. Although phosphor-coated high intensity discharge lamps—metal halide, high pressure sodium and mercury vapor, etc.—will probably be the lamp predominantly used with the luminaire, the same effects and advantages would accrue from the use of other light diffusing envelope lamps such as outside frosted incandescent lamps, or from any lamp which has a relatively large light diffusing or bright component.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What we claim is:

1. In a luminaire, the combination of:

a light source in an envelope;

a plurality of reflecting elements disposed symmetrically with respect to an optical axis passing through the light source, said elements including, a first reflector adapted to reflect rays from the light source into a zone of about 5° from the optical axis to about 30° to 40° from the optical axis, a second reflector adapted to reflect rays from the light source into a zone of about 5° from the optical axis to about 30° to 40° from the optical axis, a third reflector adapted to reflect rays from the light source into a zone of about 15° to 17° on one side of the optical axis to about 36° on the other side of the optical axis, and a fourth reflector adapted to reflect rays from the light source into a zone of about 40° from the optical axis, said forth reflector being located farthest from the light source and said first, second and third reflectors being located successively closer to the light source.

2. A luminaire according to claim 1 wherein the first, second and third reflectors are substatially elliptical and have a common first focus centered on the light source.

3. A luminaire according to claim 2 wherein the fourth reflector is substantially parabolic and has its focus centered on the light source.

4. A luminaire according to claim 2 wherein the first, second and third reflectors have their second foci located successively closer to the optical axis.

5. A luminaire according to claim 1 wherein the reflecting elements are disposed in a four-sided square and the light source is horizontally oriented.

6. A luminaire according to claim 1 wherein the reflecting elements are formed as surfaces of revolution and the light source is verticaly oriented.

7. A luminaire according to claim 1 which includes means for supporting the luminaire in a position for vertically lighting a ceiling surface and wherein the optical axis is directed toward zenith.

8. A luminaire according to claim 7 wherein the luminaire is supported at a height no greater than standing eye height.

9. A luminaire according to claim 8 wherein the luminaire is provided with a plurality of louvers close to the envelope and disposed generally radially of the light source.

10. A luminaire according to claim 1 which includes means for supporting the luminaire in a position for downlighting a working plane and wherein the optical axis is directed toward nadir.

* * * * *

UNITED STATES PATENT AND TRADEMARK OFFICE

CERTIFICATE OF CORRECTION

PATENT NO. : 4,218,727

DATED : August 19, 1980

INVENTOR(S) : Sylvan R. Shemitz, Benjamin L. Stahlheber

It is certified that error appears in the above-identified patent and that said Letters Patent are hereby corrected as shown below:

Column 1, Line 15 - "relativey" should be "relatively"

Column 1, Line 39 "ellipitcal" should be "elliptical"

Column 4, Line 16 - "66-X2+5=66-11½+59½" should be "66-X2+5=66-11½+5=59½"

Signed and Sealed this

*Eighteenth* Day of *November 1980*

[SEAL]

*Attest:*

SIDNEY A. DIAMOND

*Attesting Officer*

*Commissioner of Patents and Trademarks*